US008154204B2

(12) United States Patent
Mizokami et al.

(10) Patent No.: US 8,154,204 B2
(45) Date of Patent: Apr. 10, 2012

(54) PLASMA DISPLAY DEVICE

(75) Inventors: Kaname Mizokami, Kyoto (JP); Hiroshi Sogou, Hyogo (JP); Shigeyuki Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 288 days.

(21) Appl. No.: 12/596,787

(22) PCT Filed: Apr. 20, 2009

(86) PCT No.: PCT/JP2009/001788
§ 371 (c)(1),
(2), (4) Date: Oct. 20, 2009

(87) PCT Pub. No.: WO2009/130874
PCT Pub. Date: Oct. 29, 2009

(65) Prior Publication Data

US 2011/0204775 A1 Aug. 25, 2011

(30) Foreign Application Priority Data

Apr. 22, 2008 (JP) ..... 2008-111190

(51) Int. Cl.
*H01J 1/62* (2006.01)

(52) U.S. Cl. ..... 313/582; 313/584; 313/586

(58) Field of Classification Search ..... 313/582, 313/584, 586
See application file for complete search history.

(56) References Cited

U.S. PATENT DOCUMENTS 5,982,095 A * 11/1999 Jin et al. ..... 313/582
6,097,150 A 8/2000 Watanabe
6,753,649 B1 6/2004 Bechtel et al.
6,855,196 B2 * 2/2005 Kawamura et al. ..... 106/31.6
7,759,868 B2 7/2010 Naoi et al.
8,022,628 B2 * 9/2011 Sogou et al. ..... 313/582
2006/0232207 A1 10/2006 Sugimoto et al.
2006/0284559 A1 12/2006 Naoi et al.
2007/0103058 A1 5/2007 Yoo
2007/0152591 A1 7/2007 Yoo
2009/0167176 A1 7/2009 Fukui
2010/0213818 A1 8/2010 Naoi et al.

FOREIGN PATENT DOCUMENTS

EP 2031629 3/2009

(Continued)

OTHER PUBLICATIONS

Extended European Search Report issued Dec. 7, 2011 in European Patent Application No. 09733816.4, which is a foreign counterpart of the present application.

*Primary Examiner* — Vip Patel
(74) *Attorney, Agent, or Firm* — Wenderoth Lind & Ponack, L.L.P.

(57) ABSTRACT

A plasma display panel includes a front plate having a dielectric layer covering a display electrode formed on a substrate and a protective layer formed on the dielectric layer, and a rear plate facing the front plate so as to form a discharge space. The plasma display panel also includes an address electrode in a direction crossing the display electrode, barrier ribs for partitioning the discharge space, and phosphor layers. The protective layer is constructed by forming a ground film on the dielectric layer and adhering agglomerated particles to the ground film. The agglomerated particles are produced by coagulating a plurality of crystal particles made of metal oxide.

6 Claims, 7 Drawing Sheets

FOREIGN PATENT DOCUMENTS

| | | |
|---|---|---|
| JP | 11-153969 | 6/1999 |
| JP | 2001-118511 | 4/2001 |
| JP | 2003-303555 | 10/2003 |
| JP | 2006-244784 | 9/2006 |
| JP | 2007-035655 | 2/2007 |
| JP | 2007-048733 | 2/2007 |
| JP | 2008-021660 | 1/2008 |
| JP | 2008-293803 | 12/2008 |
| KR | 10-2006-0056869 | 5/2006 |
| WO | 2005/088688 | 9/2005 |
| WO | 2007/126061 | 11/2007 |
| WO | 2007/139184 | 12/2007 |

* cited by examiner

PLASMA DISPLAY DEVICE

This application is a U.S. National Phase Application of PCT International Application PCT/JP2009/001788.

BACKGROUND OF THE INVENTION

1. Technical Field

The present invention relates to a plasma display panel used in a display device or the like.

2. Background Art

The definition and screen size of plasma display panels (hereinafter referred to as "PDPs") can be increased, so that televisions or the like of 65 inch size are manufactured. Recently, PDPs have been applied to high definition televisions where the number of scan lines is two or more times that of a conventional National Television Standards Committee (NTSC) system, and PDPs containing no lead component are demanded in consideration of environmental issues.

A PDP is essentially formed of a front plate and a rear plate. The front plate has a glass substrate, a display electrode, a dielectric layer, and a protective layer. The glass substrate is sodium borosilicate glass produced by a float method. The display electrode includes a stripe-like transparent electrode and bus electrode formed on one surface, namely the main surface, of the glass substrate. The dielectric layer covers the display electrode and works as a capacitor. The protective layer is made of magnesium oxide (MgO) formed on the dielectric layer. While, the rear plate has the following elements:

- a glass substrate;
- a stripe-like address electrode formed on one surface, namely the main surface, of the glass substrate;
- a base dielectric layer for covering the address electrode;
- barrier ribs formed on the base dielectric layer; and
- phosphor layers that are formed between barrier ribs and emit red, green, and blue lights, respectively.

The front plate and the rear plate are hermetic sealed while the electrode forming sides of them are faced to each other. Discharge gas of Ne—Xe is filled into discharge space partitioned by the barrier ribs at a pressure of 400 to 600 Torr. The PDP selectively applies video signal voltage to the display electrode to perform discharge, and the ultraviolet rays generated by the discharge excite respective phosphor layers to emit red, green, and blue lights, and thus achieve color image display (patent document 1).

An attempt to improve the electron emission characteristic by mixing an impurity into the protective layer in the PDP is performed. When the impurity is mixed into the protective layer to improve the electron emission characteristic, however, charge is simultaneously accumulated on the surface of the protective layer, and the attenuation rate, at which the charge decreases with time, increases when the protective layer is used as a memory function. Therefore, in order to suppress the increase, measures of increasing the applied voltage or the like are required. The protective layer is required to have two following contradictory characteristics: high electron emission performance and high charge retention characteristic. The charge retention characteristic means reduction in attenuation rate of charge when the protective layer is used as a memory function.

Patent Document

[Patent document 1] Japanese Patent Unexamined Publication No. 2007-48733

SUMMARY OF THE INVENTION

The plasma display panel has the following elements:

- a front plate that has a dielectric layer for covering a display electrode formed on a substrate and a protective layer formed on the dielectric layer; and
- a rear plate that is faced to the front plate so as to form discharge space, has an address electrode in the direction crossing the display electrode, barrier ribs for partitioning the discharge space, and phosphor layers.

The protective layer is formed by forming a base film on the dielectric layer and sticking an agglomerated particle to the base film. Here, the agglomerated particle is produced by coagulating a plurality of crystal particles made of metal oxide. A hydrogen storage material is disposed in the discharge space between the front plate and rear plate.

DETAILED DESCRIPTION OF THE INVENTION

In the PDP, a protective layer formed on a dielectric layer of a front plate protects the dielectric layer from ion impact due to discharge, and emits an initial electron for causing address discharge. Protecting the dielectric layer from the ion impact is an important function of preventing increase in discharge voltage. Emitting the initial electron for causing address discharge is an important function of preventing an address discharge failure causing image flicker. In order to reduce the image flicker by increasing the number of initial electrons emitted from the protective layer, an attempt to add Si or Al to MgO is performed, for example.

Recently, the definition of televisions has been increased, and full high definition (HD) PDPs (1920×1080 pixels: progressive display) of low cost, low power consumption, and high luminance have been demanded in the market. The electron emission characteristic of the protective layer determines the image quality of the PDPs, so that it is extremely important to control the electron emission characteristic.

The present invention addresses such issues, and can provide a PDP that has the display performance of high definition and high luminance, consumes only low power, and has a long lifetime.

Exemplary Embodiment

A PDP in accordance with an exemplary embodiment of the present invention will be described hereinafter with reference to the accompanying drawings.

Figure 1:
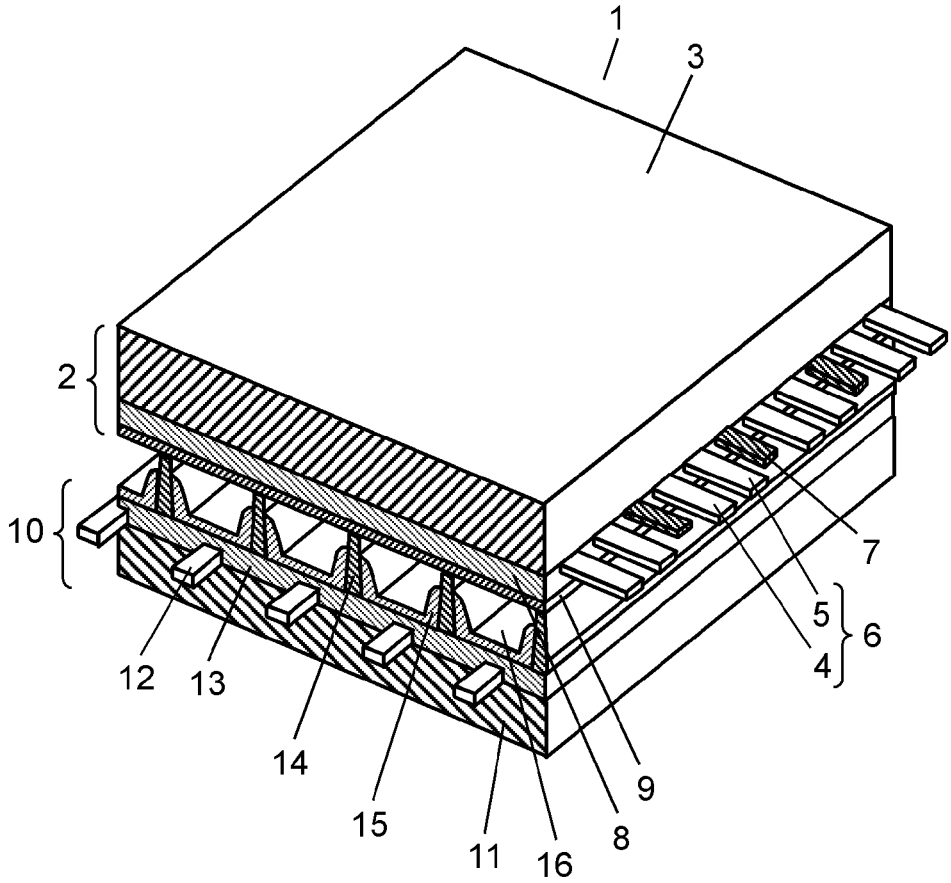
FIG. 1 is a perspective view showing a structure of a PDP in accordance with an exemplary embodiment of the present invention.

FIG. 1 is a perspective view showing a structure of the PDP in accordance with the exemplary embodiment of the present invention. The fundamental structure of the PDP is similar to that of a typical alternating-current surface discharge type PDP. In PDP 1, as shown in FIG. 1, front plate 2 formed of front glass substrate 3 and other components is faced to rear plate 10 formed of rear glass substrate 11 and the like, and their outer peripheries are hermetic sealed by a sealing material such as glass frit. Discharge gas of Ne and Xe is filled into discharge space 16 inside the sealed PDP 1 at a pressure of 400 to 600 Torr.

A plurality of columns of pairs of band-like display electrodes 6 each of which is formed of scan electrode 4 and sustain electrode 5 and a plurality of columns of black stripes (light shielding layers) 7 are disposed in parallel on front glass substrate 3 of front plate 2. Dielectric layer 8 functioning as a capacitor so as to cover display electrodes 6 and light shielding layers 7 is formed on front glass substrate 3, and protective layer 9 made of magnesium oxide (MgO) or the like is formed on the surface of dielectric layer 8.

A plurality of band-like address electrodes 12 are disposed on rear glass substrate 11 of rear plate 10 in parallel in the direction orthogonal to scan electrodes 4 and sustain electrodes 5 of front plate 2, and address electrodes 12 are covered with base dielectric layer 13. Barrier ribs 14 of a predetermined height for partitioning discharge space 16 are formed on base dielectric layer 13 between address electrodes 12. Phosphor layers 15 for emitting red, green, and blue lights through ultraviolet rays are sequentially applied to grooves between barrier ribs 14 correspondingly to respective address electrodes 12. Discharge cells are formed at the intersecting positions of scan electrodes 4 and address electrodes 12 and at the intersecting positions of sustain electrodes 5 and address electrodes 12. The discharge cells having phosphor layers 15 for red, green, and blue colors that are aligned in the direction of display electrodes 6 become pixels for color display.

Thus, front plate 2 and rear plate 10 that have predetermined components are faced to each other so that scan electrodes 4 are orthogonal to address electrodes 12, the periphery of them is sealed by glass frit, and discharge gas of Ne and Xe is filled into discharge space 16, thereby completing PDP 1.

Figure 2:
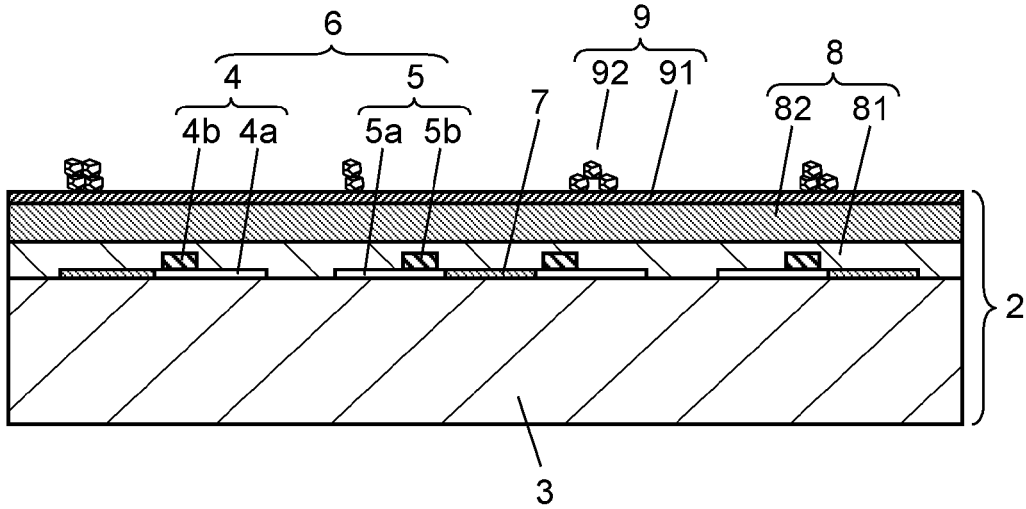
FIG. 2 is a sectional view showing a structure of a front plate of the PDP in accordance with the exemplary embodiment.

FIG. 2 is a sectional view showing a structure of front plate 2 of PDP 1 in accordance with the exemplary embodiment. As shown in FIG. 2, light shielding layers 7 and display electrodes 6 formed of scan electrodes 4 and sustain electrodes 5 are formed in a certain pattern on front glass substrate 3 manufactured by the float method or the like. Scan electrode 4 and sustain electrode 5 include transparent electrodes 4*a* and 5*a* made of indium tin oxide (ITO) or tin oxide ($SnO_2$), and metal bus electrodes 4*b* and 5*b* formed on transparent electrodes 4*a* and 5*a*, respectively. Metal bus electrodes 4*b* and 5*b* are used for applying conductivity in the longitudinal direction of transparent electrodes 4*a* and 5*a*, and are made of a conductive material mainly containing silver (Ag).

Dielectric layer 8 has a two-layer structure including first dielectric layer 81 and second dielectric layer 82. First dielectric layer 81 covers transparent electrodes 4*a* and 5*a*, metal bus electrodes 4*b* and 5*b*, and light shielding layers 7 which are formed on front glass substrate 3. Second dielectric layer 82 is formed on first dielectric layer 81. Protective layer 9 is formed on second dielectric layer 82.

Next, the manufacturing method of front plate 2 is described. Scan electrodes 4, sustain electrodes 5, and light shielding layers 7 are firstly formed on front glass substrate 3. Transparent electrodes 4*a* and 5*a* and metal bus electrodes 4*b* and 5*b* are formed by patterning using a photolithography method. Transparent electrodes 4*a* and 5*a* are formed using a thin film process or the like, and metal bus electrodes 4*b* and 5*b* are formed by firing paste containing a silver (Ag) material at a desired temperature and solidifying it. Light shielding layers 7 are similarly formed by a method of screen-printing paste containing a black pigment and then firing the paste, or by a method of forming the black pigment on the whole surface of a glass substrate, then patterning it using the photolithography method, and firing it.

Next, dielectric paste is applied to front glass substrate 3 by a die coating method or the like so as to cover scan electrodes 4, sustain electrodes 5, and light shielding layers 7, thereby forming a dielectric paste layer (dielectric material layer). When the dielectric paste is left for a predetermined time after its application, the surface of the applied dielectric paste is leveled to become flat. Then, the dielectric paste layer is fired and solidified, thereby forming dielectric layer 8 covering scan electrodes 4, sustain electrodes 5, and light shielding layers 7. The dielectric paste is paint containing a dielectric material such as glass powder, a binder, and a solvent. Next, protective layer 9 made of magnesium oxide (MgO) is formed on dielectric layer 8 by a vacuum deposition method. A predetermined structure (electrodes 4, sustain electrodes 5, light shielding layers 7, dielectric layer 8, and protective layer 9) is formed on front glass substrate 3 in the above-mentioned steps, thereby completing front plate 2.

Figure 3:
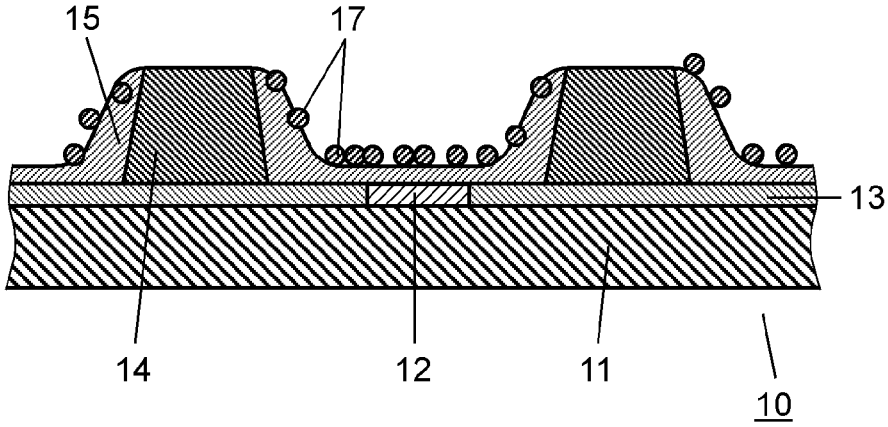
FIG. 3 is a sectional view showing a structure of a rear plate of the PDP in accordance with the exemplary embodiment.

FIG. 3 is a sectional view showing a structure of rear plate 10 of PDP 1 in accordance with the exemplary embodiment of the present invention. As shown in FIG. 3, a material layer as a component for address electrodes 12 is formed on rear glass substrate 11, and the material layer is fired at a desired temperature, thereby forming address electrodes 12. Here, the material layer is formed using a method of screen-printing paste containing silver (Ag) material, or a method of forming a metal film on the whole surface and then patterning it using the photolithography method. Next, dielectric paste is applied to rear glass substrate 11 having address electrodes 12 by the die coating method or the like so as to cover address electrodes 12, thereby forming a dielectric paste layer. Then, the dielectric paste layer is fired to form base dielectric layer 13. The dielectric paste is paint containing a dielectric material such as glass powder, a binder, and a solvent.

Next, paste for barrier rib formation containing a barrier rib material is applied to base dielectric layer 13, and is patterned in a predetermined shape, thereby forming a barrier rib material layer. Then, barrier ribs 14 are formed by firing the barrier rib material layer. Here, as the method of patterning the paste for barrier ribs applied to base dielectric layer 13, the photolithography method or a sand blast method can be employed. Next, phosphor paste containing a phosphor material is applied to the upper surface of base dielectric layer 13 and side surfaces of barrier ribs 14 between adjacent barrier ribs 14, and is fired, thereby forming phosphor layer 15.

Granular hydrogen storage material 17 with a grain diameter of 0.1 to 20 μm is dispersed and stuck on the surface of phosphor layer 15. Hydrogen storage material 17 is stuck at a coverage factor of 50% or lower not to interfere with the light emission of phosphors. Here, the coverage factor means the percentage in which hydrogen storage material 17 covers phosphor layers 15. Hydrogen storage material 17 is dispersed on phosphor layer 15 in a dotted manner in FIG. 3, but hydrogen storage material 17 may be dispersed in phosphor layer 15.

As hydrogen storage material 17 storing hydrogen, platinum group powder made of one or more of platinum (Pt), palladium (Pd), ruthenium (Ru), rhodium (Rh), iridium (Ir), and osmium (Os) can be employed, but palladium is particularly preferable. As hydrogen storage material 17, compound can be employed which contains one or more of platinum, palladium, ruthenium, rhodium, iridium, and osmium, and one or more of transition metals of titanium (Ti), manganese (Mn), zirconium (Zr), nickel (Ni), cobalt (Co), lanthanum (La), iron (Fe), and vanadium (V). Also in this case, an alloy containing palladium is preferable.

As the method of dispersing hydrogen storage material 17 on phosphor layer 15, a spray method can be used, for example. In the method of dispersing hydrogen storage material 17 in phosphor layer 15, platinum group powder may be previously mixed when phosphor layer 15 is formed. Preferably, the grain diameter of the platinum group powder is between 0.1 and 20 μm inclusive, and the mixing ratio of the platinum group powder to the phosphor powder is between 0.01% and about 2% inclusive. The filling rate of the phosphor in phosphor layer 15 is 60%, which is small, so that the effect of storing hydrogen is kept even when the platinum group powder is dispersed inside phosphor layer 15.

First dielectric layer 81 and second dielectric layer 82 forming dielectric layer 8 of front plate 2 are hereinafter described in detail. The dielectric material of first dielectric layer 81 has the following material composition. The material composition contains bismuth oxide ($Bi_2O_3$) of 20 wt % to 40 wt %, at least one (0.5 wt % to 12 wt %) selected from calcium oxide (CaO), strontium oxide (SrO), and barium oxide (BaO), and at least one (0.1 wt % to 7 wt %) selected from molybdenum oxide ($MoO_3$), tungsten oxide ($WO_3$), cerium oxide ($CeO_2$), and manganese dioxide ($MnO_2$).

The dielectric material may contain, instead of molybdenum oxide ($MoO_3$), tungsten oxide ($WO_3$), cerium oxide ($CeO_2$), and manganese dioxide ($MnO_2$), at least one (0.1 wt % to 7 wt %) selected from copper oxide (CuO), chromium oxide ($Cr_2O_3$), cobalt oxide ($Co_2O_3$), vanadium oxide ($V_2O_7$), and antimony oxide ($Sb_2O_3$).

The dielectric material may additionally have material composition that does not contain lead component, for example, zinc oxide (ZnO) of 0 wt % to 40 wt %, boron oxide ($B_2O_3$) of 0 wt % to 35 wt %, silicon oxide ($SiO_2$) of 0 wt % to 15 wt %, or aluminum oxide ($Al_2O_3$) of 0 wt % to 10 wt %. The contents of these materials are not especially limited, and are set within the content range of the material composition of the conventional art.

The dielectric material made of these components is milled with a wet jet mill or a ball mill so that the average grain diameter is between 0.5 and 2.5 μm inclusive, thereby producing dielectric material powder. Next, the dielectric material powder of 55 wt % to 70 wt % is sufficiently kneaded with binder component of 30 wt % to 45 wt % using three rolls, thereby producing paste for the first dielectric layer used for die coating or printing.

The binder component is ethylcellulose, terpineol containing acrylic resin of 1 wt % to 20 wt %, or butyl carbitol acetate. A plasticizer and dispersant may be added to the paste as required to improve the printing property. The plasticizer includes dioctyl phthalate, dibutyl phthalate, triphenyl phosphate, or tributyl phosphate. The dispersant includes glycerol monooleate, sorbitan sesquioleate, Homogenol (manufactured by Kao Corporation), or an alkylallyl phoshate.

Next, the paste for the first dielectric layer is printed and dried on front glass substrate 3 so as to cover display electrodes 6 by the die coating method or the screen printing method, and then is fired in the range of 575° C. to 590° C., which is slightly higher than the softening point of the dielectric material.

Next, second dielectric layer 82 is described. The dielectric material of second dielectric layer 82 has the following material composition. The material composition contains bismuth oxide ($Bi_2O_3$) of 11 wt % to 20 wt %, at least one (1.6 wt % to 21 wt %) selected from calcium oxide (CaO), strontium oxide (SrO), and barium oxide (BaO), and at least one (0.1 wt % to 7 wt %) selected from molybdenum oxide ($MoO_3$), tungsten oxide ($WO_3$), and cerium oxide ($CeO_2$).

The dielectric material may contain, instead of molybdenum oxide ($MoO_3$), tungsten oxide ($WO_3$), and cerium oxide ($CeO_2$), at least one (0.1 wt % to 7 wt %) selected from copper oxide (CuO), chromium oxide ($Cr_2O_3$), cobalt oxide ($CO_2O_3$), vanadium oxide ($V_2O_7$), antimony oxide ($Sb_2O_3$), and manganese dioxide ($MnO_2$).

The dielectric material may additionally have material composition that does not contain lead component, for example, zinc oxide (ZnO) of 0 wt % to 40 wt %, boron oxide ($B_2O_3$) of 0 wt % to 35 wt %, silicon oxide ($SiO_2$) of 0 wt % to 15 wt %, or aluminum oxide ($Al_2O_3$) of 0 wt % to 10 wt %. The contents of these materials are not especially limited, and are set within the content range of the material composition of the conventional art.

The dielectric material made of these components is milled with a wet jet mill or a ball mill so that the average grain diameter is between 0.5 and 2.5 μm inclusive, thereby producing dielectric material powder. Next, the dielectric material powder of 55 wt % to 70 wt % is sufficiently kneaded with binder component of 30 wt % to 45 wt % using three rolls, thereby producing paste for the second dielectric layer used for die coating or printing. The binder component is ethylcellulose, terpineol containing acrylic resin of 1 wt % to 20 wt %, or butyl carbitol acetate. A plasticizer and dispersant may be added to the paste as required to improve the printing property. The plasticizer includes dioctyl phthalate, dibutyl phthalate, triphenyl phosphate, or tributyl phosphate. The dispersant includes glycerol monooleate, sorbitan sesquioleate, Homogenol (manufactured by Kao Corporation), or an alkylallyl phoshate.

Next, the paste for the second dielectric layer is printed and dried on first dielectric layer 81 by the screen printing method or the die coating method, and then is fired in the range of 550° C. to 590° C., which is slightly higher than the softening point of the dielectric material.

The thickness of dielectric layer 8, namely the sum of the thicknesses of first dielectric layer 81 and second dielectric layer 82, is preferably set to be 41 μm or less in order to secure the visual light transmittance. In first dielectric layer 81, in order to suppress reaction of metal bus electrodes 4*b* and 5*b* with silver (Ag), the content of bismuth oxide ($Bi_2O_3$) is made larger than that in second dielectric layer 82, namely between 20 and 40 wt % inclusive. Therefore, the visual light transmittance of first dielectric layer 81 is lower than that of second dielectric layer 82, so that the thickness of first dielectric layer 81 is set to be less than that of second dielectric layer 82.

When the content of bismuth oxide ($Bi_2O_3$) in second dielectric layer 82 is 11 wt % or less, coloring occurs seldom but an air bubble is apt to be generated in second dielectric layer 82, disadvantageously. When the content of bismuth oxide ($Bi_2O_3$) in second dielectric layer 82 exceeds 40 wt %, coloring is apt to occur and hence interferes with increase in transmittance, disadvantageously.

The panel luminance is obviously improved and discharge voltage is reduced with decrease in thickness of dielectric layer 8, so that it is preferable to minimize the thickness as long as the dielectric voltage does not decrease. From such viewpoint, in the embodiment of the present invention, the thickness of dielectric layer 8 is set to be 41 μm or less, that of first dielectric layer 81 is set to be between 5 and 15 μm inclusive, and that of second dielectric layer 82 is set to be between 20 and 36 μm inclusive.

In the PDP manufactured in the above-mentioned manner, even when silver (Ag) is contained in display electrodes 6, the coloring phenomenon (yellowing) of front glass substrate 3 occurs seldom, any air bubble is not generated in dielectric layer 8, and dielectric layer 8 having high dielectric breakdown voltage performance can be achieved.

Next, the reason why yellowing and air bubble generation is suppressed by these dielectric materials in first dielectric layer 81 in the PDP of the embodiment of the present invention is considered. By adding molybdenum oxide ($MoO_3$) or tungsten oxide ($WO_3$) to dielectric glass containing bismuth oxide ($Bi_2O_3$), compound such as $Ag_2MoO_4$, $Ag_2Mo_2O_7$, $Ag_2Mo_4O_{13}$, $Ag_2WO_4$, $Ag_2W_2O_7$, or $Ag_2W_4O_{13}$ is apt to be produced at a low temperature of 580° C. or lower. Since the firing temperature of dielectric layer 8 is between 550° C. and 590° C. inclusive in the embodiment of the present invention, silver ions ($Ag^+$) having diffused in dielectric layer 8 during firing react with molybdenum oxide ($MoO_3$), tungsten oxide ($WO_3$), cerium oxide ($CeO_2$), and manganese dioxide ($MnO_2$) in dielectric layer 8, generate stable compound, and become stable. In other words, since silver ions ($Ag^+$) are stabilized without being reduced, colloid is not generated by coagulation. Therefore, the stabilization of silver ions ($Ag^+$) reduces oxygen generation that is caused by putting the silver (Ag) into the colloid state, so that air bubble generation in dielectric layer 8 is reduced.

In order to make these effects effective, the contents of molybdenum oxide ($MoO_3$), tungsten oxide ($WO_3$), cerium oxide ($CeO_2$), and manganese dioxide ($MnO_2$) in the dielectric glass containing bismuth oxide ($Bi_2O_3$) are preferably set at 0.1 wt % or more, more preferably between 0.1 and 7 wt % inclusive. Especially, the effect of suppressing the yellowing is small at a content less than 0.1 wt %, and coloring occurs in glass at a content more than 7 wt %, disadvantageously.

In other words, in dielectric layer 8 of the PDP of the embodiment of the present invention, the yellowing phenomenon and air bubble generation are suppressed in first dielectric layer 81 that is in contact with metal bus electrodes 4*b* and 5*b* made of silver (Ag) material, and high light transmittance is achieved by second dielectric layer 82 disposed on first dielectric layer 81. As a result, dielectric layer 8 can wholly achieve a PDP where the air bubble or yellowing occurs seldom and the transmittance is high.

Next, the structure and manufacturing method of a protective layer as a feature of the PDP of the present invention is described.

Figure 4:
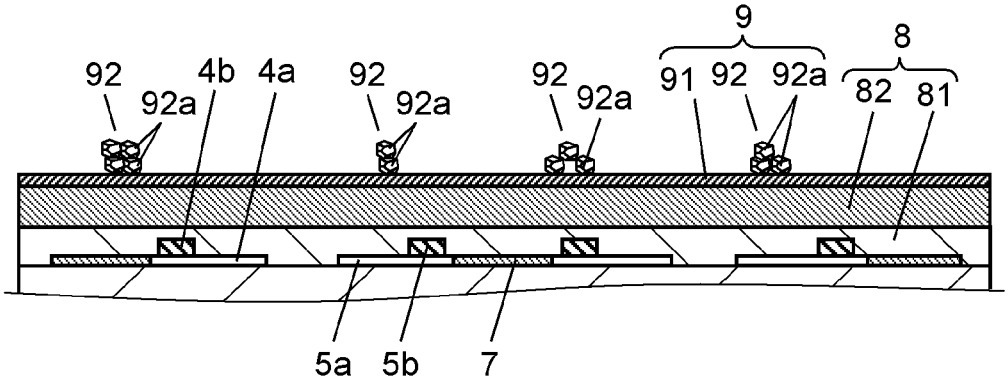
FIG. 4 is an enlarged illustration showing a protective layer part of the PDP in accordance with the exemplary embodiment.

FIG. 4 is an enlarged illustration showing a protective layer part of the PDP in accordance with the exemplary embodiment of the present invention. In the PDP of the present invention, as shown in FIG. 4, protective layer 9 is produced by forming base film 91 on dielectric layer 8, discretely dispersing agglomerated particles 92 on base film 91, and sticking the grains so that they are distributed substantially uniformly over the whole surface. Base film 91 is made of MgO containing Al as impurity. Each agglomerated particle 92 is formed by coagulating crystal particles 92*a* made of MgO, metal oxide.

Figure 5:
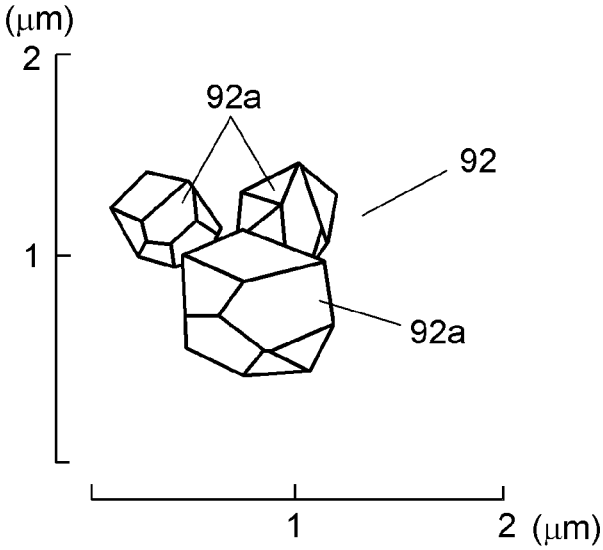
FIG. 5 is an enlarged view showing agglomerated particles on the protective layer of the PDP in accordance with the exemplary embodiment.

FIG. 5 is an enlarged view showing agglomerated particles in accordance with the exemplary embodiment of the present invention. Agglomerated particle 92 means a state where crystal particles 92*a* with a predetermined primary grain diameter are coagulated or necked, as shown in FIG. 5. In this state, the crystal particles are not bonded to each other like solid by a large bonding force, but a plurality of primary grains are bonded to each other into an assembly by static electricity or Van der Waals force. The bonding is in the extent that a part or the whole of the assembly is put into a primary grain state by external stimulus such as ultrasonic wave. Preferably, the diameter of agglomerated particles 92 is about 1 μm, and crystal particles 92*a* have a polyhedral shape having seven or more surfaces, such as tetradecahedron or dodecahedron.

The diameter of the primary grains of crystal particles 92*a* made of MgO can be controlled in response to the generation condition of crystal particles 92*a*. For example, when the primary grains are produced by firing MgO precursor such as magnesium carbonate or magnesium hydrate, the grain diameter can be controlled by controlling the firing temperature and firing atmosphere. The firing temperature can be generally selected in a range of about 700° C. to 1500° C., but the primary grain diameter can be controlled to the range of 0.3 to about 2 μm by setting the firing temperature to 1000° C. or higher, which is relatively high. Since crystal particles 92*a* are produced by heating the MgO precursor, agglomerated particles 92 where a plurality of primary grains are bonded to each other by a phenomenon called coagulation or necking can be formed in the producing process.

Next, an result of the experiment performed for recognizing the effect of the PDP having the protective layer of the present invention is described.

Figure 6:
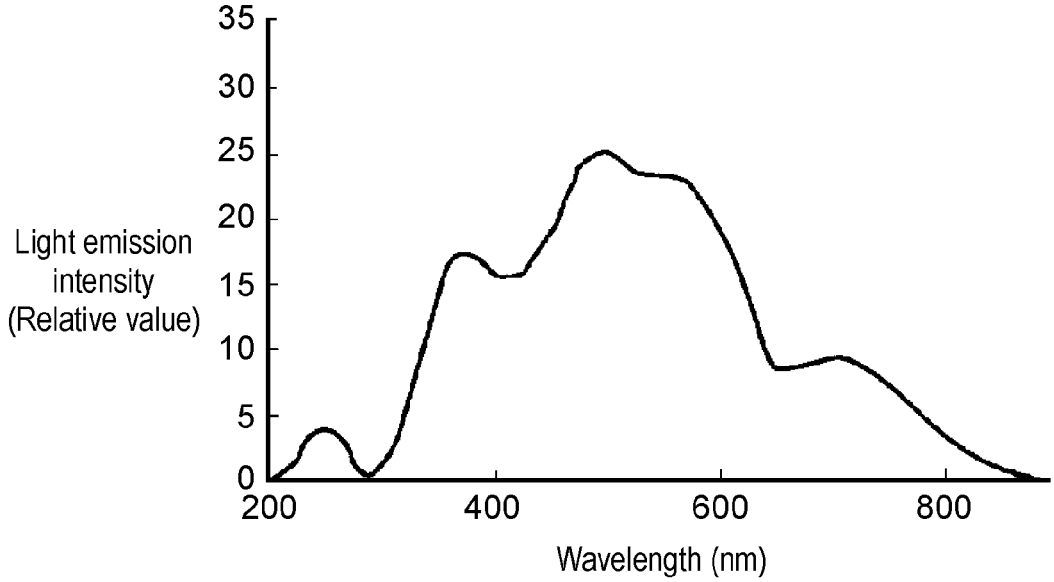
FIG. 6 is a characteristic diagram showing a cathode luminescence measuring result of crystal particles.

PDPs having protective layers of different structures are produced as prototypes. Prototype 1 is a PDP having only a protective layer made of MgO. Prototype 2 is a PDP having a protective layer made of MgO doped with impurities such as Al and Si. Prototype 3 is a PDP where only primary grains of the crystal particles made of metal oxide are dispersed and stuck on a protective layer made of MgO. Prototype 4 is the PDP of the present invention in which agglomerated particles formed by coagulating crystal particles are substantially uniformly distributed and stuck to the whole surface of a base film made of MgO. In prototypes 3 and 4, single crystal particles of MgO are used as metal oxide. When the cathode luminescence of the crystal particles used in prototype 4 of the present invention is measured, it has a characteristic shown in FIG. 6. FIG. 6 is a characteristic diagram showing a cathode luminescence measuring result of crystal particles 92*a*. In FIG. 6, the horizontal axis shows wavelength, and the vertical axis shows light emission intensity.

The electron emission performance and charge retention performance of the PDPs having four protective layer structures are investigated.

The electron emission performance is expressed by a numerical value, and the larger the electron emission performance is, the larger the electron emission amount is. The electron emission performance is expressed by an initial electron emission amount determined by the surface state of discharge, gas type, and gas state. The initial electron emission amount can be measured by a method of radiating ions or electron beams to the surface and measuring the electron current amount emitted from the surface, but it is difficult to non-destructively evaluate the surface of the front plate of the panel. As shown in Japanese Patent Unexamined Publication No. 2007-48733, the numerical value, called as statistical delay time, serving as a guide of easiness to occur of discharge, of delay times during discharge, is measured, and the inverse of the statistical delay time is integrated, thereby providing a numerical value corresponding to the initial electron emission amount and the linearity. Therefore, the electron emission performance is evaluated using this numerical value. The delay times during discharge mean the times of discharge delay—the discharge delays after the rising of a pulse. The discharge delay is considered to be caused mainly by the fact that an initial electron, which triggers the start of the discharge, is hardly emitted from the surface of the protective layer into the discharge space.

As the index of the charge retention performance, the voltage value of the voltage (hereinafter referred to as "Vscn lighting voltage") is used which is to be applied to the scan electrodes and is required for suppressing charge emission phenomenon when a PDP is produced. In other words, low Vscn lighting voltage indicates high charge retention performance. Therefore, the PDP can be driven at low voltage, so that a component of low breakdown-voltage and low capacity can be used as a power supply or each electric component when the PDP is designed. In the products under the current circumstances, an element of a withstand voltage of about 150 V is used as a semiconductor switching element such as a metal oxide semiconductor field effect transistor (MOSFET) for sequentially applying scan voltage to the panel, and the Vscn lighting voltage is preferably suppressed to 120 V or lower in consideration of variation by temperature.

Figure 7:
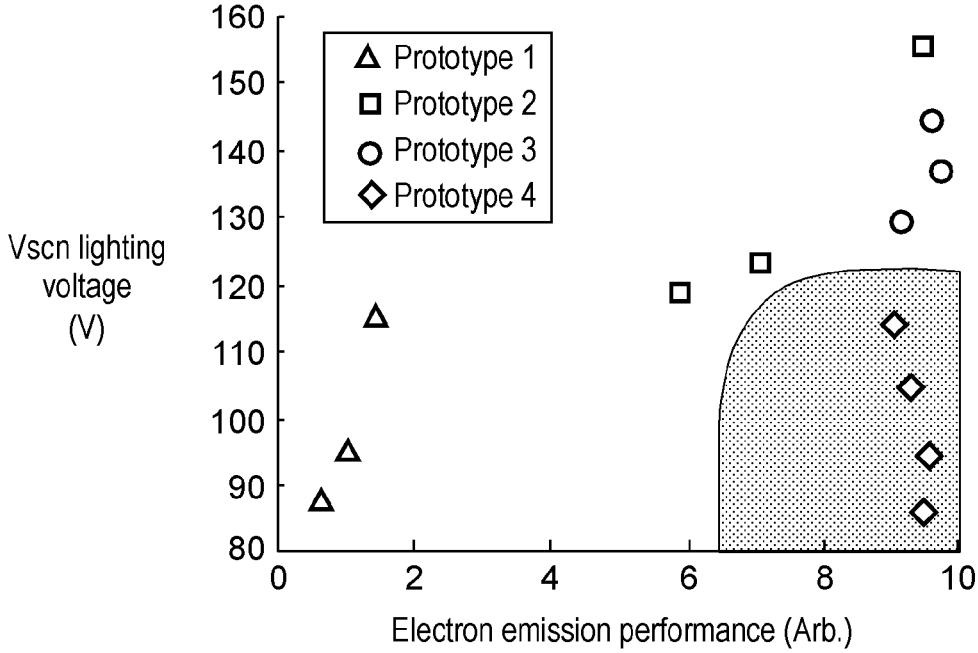
FIG. 7 is a characteristic diagram showing an electron emission characteristic of the PDP and the study contents of Vscn lighting voltage in the result of an experiment having been performed for illustrating the effect of the present invention.

FIG. 7 shows an investigating result of the electron emission performance and charge retention performance. In FIG. 7, the horizontal axis shows electron emission performance, and the vertical axis shows Vscn lighting voltage. In prototype 4 of the present invention in which agglomerated particles formed by coagulating single crystal particles of MgO are dispersed on the base film of MgO and are stuck so that they are distributed substantially uniformly over the whole surface, as is clear from FIG. 7, the Vscn lighting voltage can be suppressed to 120 V or lower in evaluating the charge retention performance. Additionally, the electron emission performance can be sufficient characteristic of six or higher.

In other words, generally, the electron emission performance and charge retention performance of the protective layer of the PDP are mutually contradictory. The electron emission performance can be improved by changing the film producing condition of the protective layer or doping the protective layer with impurities such as Al, Si, or Ba during the film production, but the Vscn lighting voltage increases as a side effect.

In the PDP having the protective layer of the present invention, the characteristic as the electron emission performance can be six or higher, and the Vscn lighting voltage as the charge retention performance can be 120 V or lower. Therefore, the PDP having the protective layer of the present invention can satisfy both the electron emission performance and charge retention performance in the protective layer when the PDP has a tendency that increase in definition increases the number of scan lines and decreases the cell size.

The grain diameter of crystal particles 92*a* is described. In the following description, the grain diameter means the average grain diameter, and the average grain diameter means volume cumulative average diameter (D50).

Figure 8:
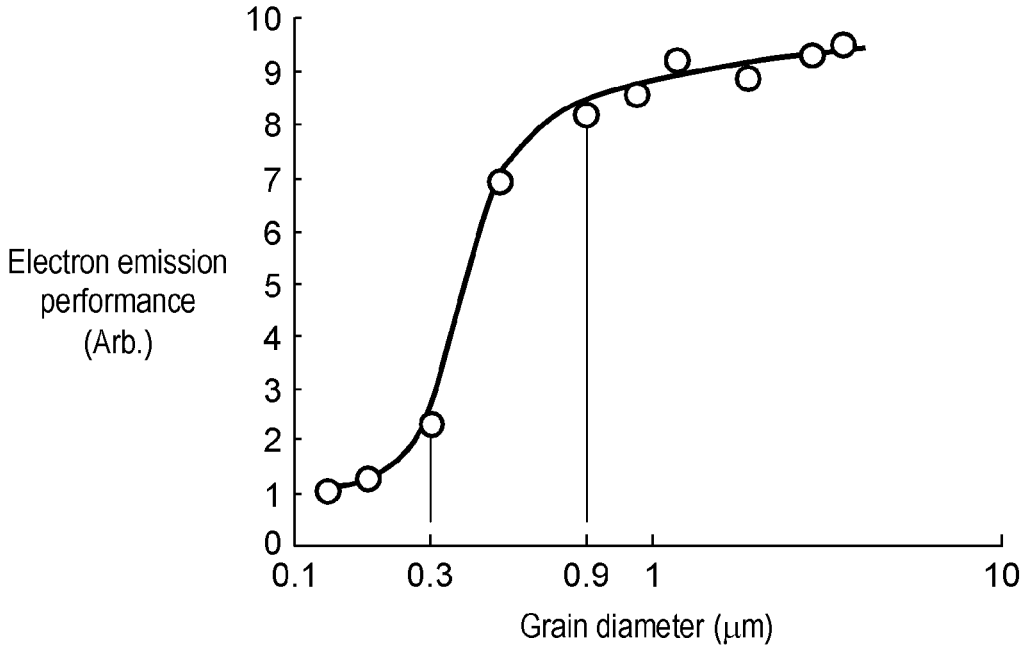
FIG. 8 is a characteristic diagram showing the relation between the grain diameter of the crystal particles and the electron emission characteristic.

FIG. 8 shows an experimental result of investigating the electron emission performance while the diameter of the crystal particles of MgO is varied in prototype 4 of the present invention shown in FIG. 7. In FIG. 8, the horizontal axis shows grain diameter, and the vertical axis shows electron emission performance. The grain diameter of the crystal particles of MgO is measured by scanning electron microscope (SEM) observation of the crystal particles in FIG. 8.

As shown in FIG. 8, the electron emission performance is low when the grain diameter is short, namely about 0.3 μm, and is high when the grain diameter is about 0.9 μm or longer.

In order to increase the number of emitted electrons in the discharge cell, it is preferable that the number of crystal particles per unit area on the base layer is large. However, according to the experiment by the inventors, the following phenomenon occurs: the existence of crystal particles in a part corresponding to the tops of the barrier ribs of the rear plate that are in tight contact with the protective layer of the front plate causes the tops of the barrier ribs to break, the material of the tops comes on the phosphor, and hence the cell is not normally lit up or lit out. The phenomenon of the breakage of the barrier ribs hardly occurs when the crystal particles do no exist in the part corresponding to the tops of the barrier ribs, so that increase of the number of crystal particles to be stuck increases the breakage occurrence probability of the barrier ribs.

Figure 9:
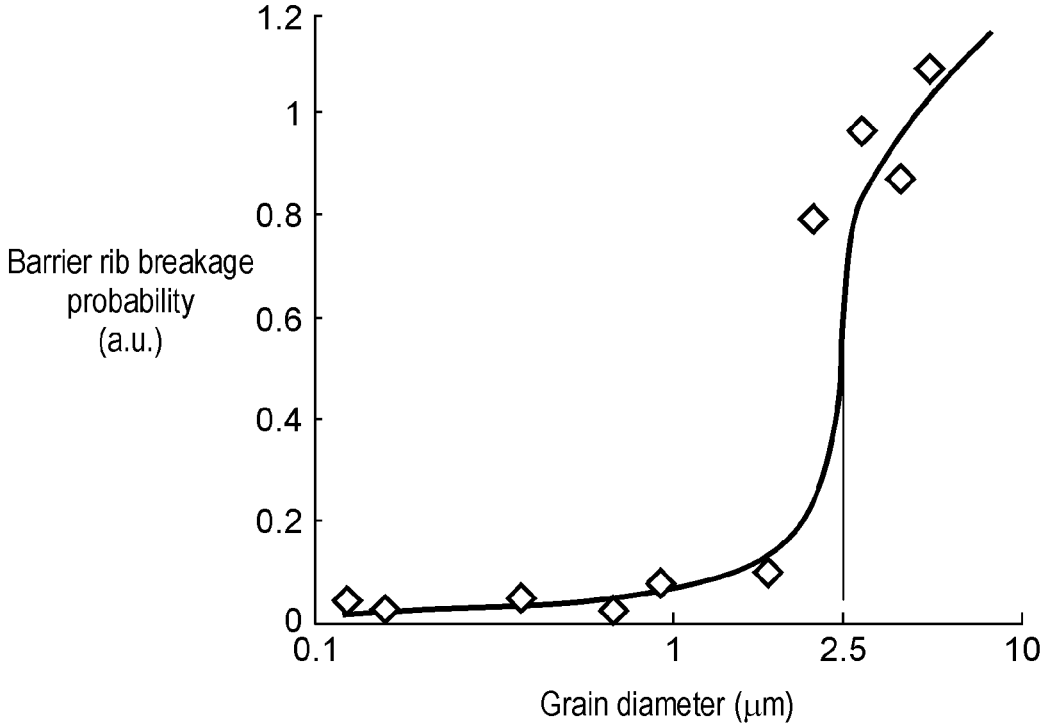
FIG. 9 is a characteristic diagram showing the relation between the grain diameter of the crystal particles and the occurrence rate of breakage of barrier ribs.

FIG. 9 is a diagram showing the result of dispersing the same number of crystal particles with different diameters per unit area and investigating the relation of the breakage of the barrier ribs in prototype 4 of the present invention shown in FIG. 7. In FIG. 9, the horizontal axis shows grain diameter, and the vertical axis shows the breakage probability of the barrier ribs.

As is clear from FIG. 9, the breakage probability of the barrier ribs sharply increases when the diameter of the crystal particles increases to about 2.5 μm, but the breakage probability of the barrier ribs can be suppressed to relatively small when the diameter of the crystal particles is shorter than 2.5 μm.

According to the result, it is considered to be preferable that the grain diameter of the crystal particles is between 0.9 and 2.5 μm inclusive in the protective layer of the PDP of the present invention. In the case of mass production of PDPs, however, it is required to consider the variation in manufacturing the crystal particles and the variation in manufacturing the protective layer.

Figure 10:
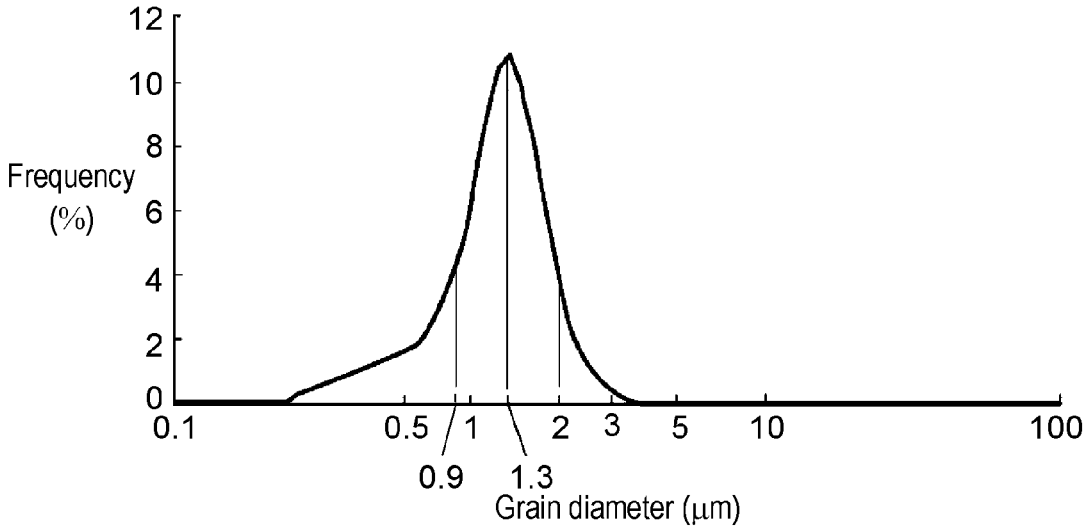
FIG. 10 is a characteristic diagram showing one example of grain size distribution of the agglomerated particles in the PDP of the present invention.

In order to consider a cause of such variation in manufacturing, an experiment is performed using the crystal particles of different grain diameter distribution. FIG. 10 shows the result of the experiment. In FIG. 10, the horizontal axis shows grain diameter, and the vertical axis shows the frequency. As shown in FIG. 10, when agglomerated particles with average diameter of 0.9 and 2.5 μm are used, the above-mentioned effect of the present invention can be stably produced.

Figure 11:
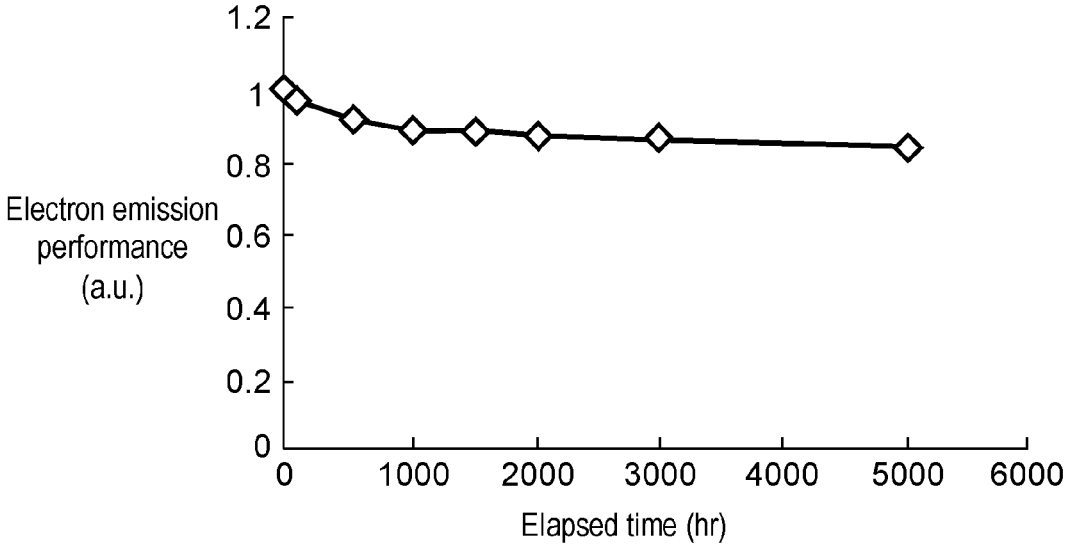
FIG. 11 is a characteristic diagram showing the result of an experiment having been performed for illustrating the effect of a hydrogen storage material of the present invention.

FIG. 11 shows the experimental result of a degradation acceleration test where the degradation with time of the electron emission characteristic of agglomerated particles is investigated in the PDP of the present invention, and shows the variation in electron emission characteristic with elapsed time. In FIG. 11, the horizontal axis shows elapsed time, and the vertical axis shows electron emission performance.

As shown in FIG. 11, in the PDP to which the hydrogen storage material of platinum group element is stuck, the degradation with time of the electron emission characteristic is significantly suppressed. This is for the following reason. By discharging the PDP, impurity gas is released from the protective layer, barrier ribs, and phosphor layers, the impurity gas adsorbs to the surface of the protective layer again, and the characteristic is degraded by aging. However, water molecules and hydrocarbon molecules in the impurity gas are decomposed into hydrogen atoms, oxygen atoms, and carbon atoms, and the platinum group element has property of storing a large amount of hydrogen. Therefore, the platinum group element stores hydrogen atoms, and hence the water and hydrocarbon can be removed. As a result, characteristic degradation by aging can be suppressed.

In the embodiment of the present invention shown in FIG. 11, agglomerated particles 92 formed by coagulating a plurality of crystal particles 92*a* made of MgO are stuck to protective layer 9, and hydrogen storage material made of powder of platinum group element (platinum, palladium, ruthenium, rhodium, iridium, or osmium) is stuck on phosphor layers 15, the tops of barrier ribs 14, and protective layer 9. However, in addition to this, alloy powder of the platinum group element and transition metal (titanium, manganese, zirconium, nickel, cobalt, lanthanum, iron, or vanadium) can be used. As a method of sticking the hydrogen storage material, a printing method, a spray method, a photolithography method, a dispenser method, or an ink jet method can be used. The hydrogen storage material is kneaded with an organic binder to produce paste as required.

As a place to which the hydrogen storage material of the platinum group element is stuck, a place where discharge occurs during image display of the PDP or the proximity thereof is preferable.

Figure 12:
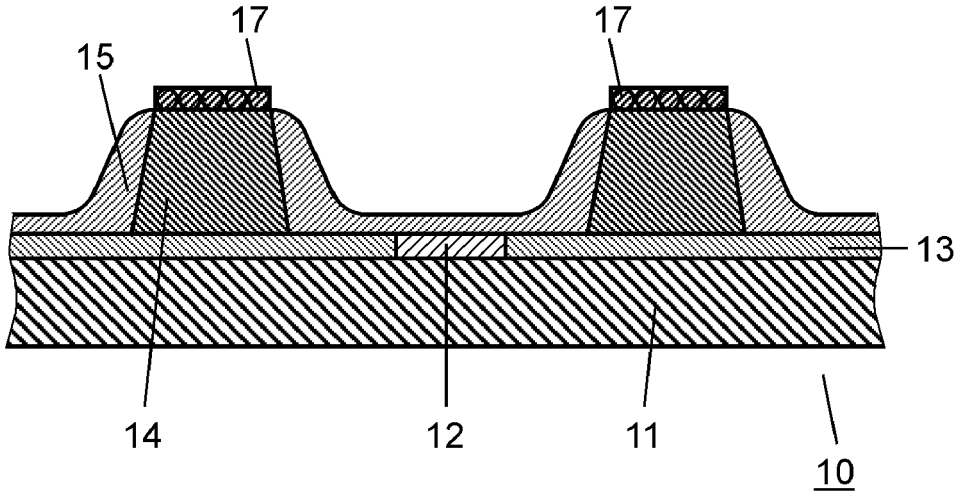
FIG. 12 is a sectional view showing a structure of another example of the rear plate of the PDP of the present invention.
Figure 13:
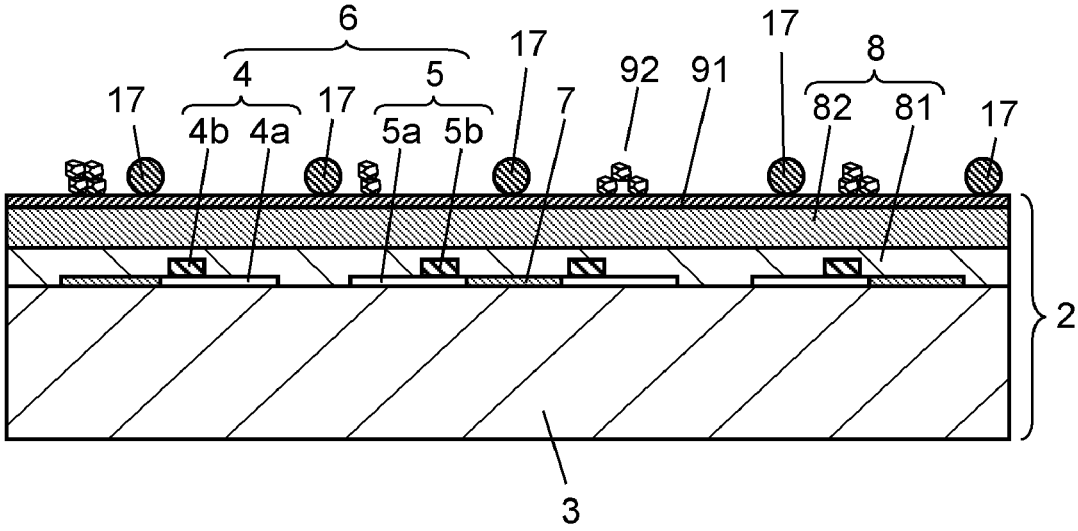
FIG. 13 is a sectional view showing a structure of another example of the front plate of the PDP of the present invention.

FIG. 12 and FIG. 13 show one example of the place. In the example of FIG. 12, hydrogen storage material 17 is disposed on the surfaces of barrier ribs 14, especially, on the tops of barrier ribs 14. In the example of FIG. 12, the grain diameter of the platinum group powder is required to be an extent that no large clearance occurs between barrier ribs 14 and protective layer 9, and is preferably between 0.1 and 5 μm inclusive. An extent that the tops of barrier ribs 14 are dotted with the platinum group powder is also allowed. When barrier ribs 14 have a porous structure, hydrogen storage material 17 may be contained in barrier ribs 14.

In the example of FIG. 13, hydrogen storage material 17 is disposed on protective layer 9 of front plate 2. In the example of FIG. 13, the coverage factor of protective layer 9 by the hydrogen storage material is preferably 50% or lower so that the platinum group powder does not interfere with the transmission of visual light.

In the PDP having protective layer 9 and hydrogen storage material 17 in the present invention, the characteristic as the electron emission performance can be six or higher, and the Vscn lighting voltage as the charge retention performance can be 120 V or lower. Therefore, both the electron emission performance and charge retention performance can be satisfied in the protective layer of the PDP having a tendency that increase in definition increases the number of scan lines and decreases the cell size. The electron emission performance hardly degrades with time, so that a PDP can be achieved which has display performance of high definition and high luminance, consumes only low power, and has a long lifetime.

Next, manufacturing steps of forming protective layer 9 of the PDP of the present invention are described with reference to FIG. 14.

Figure 14:
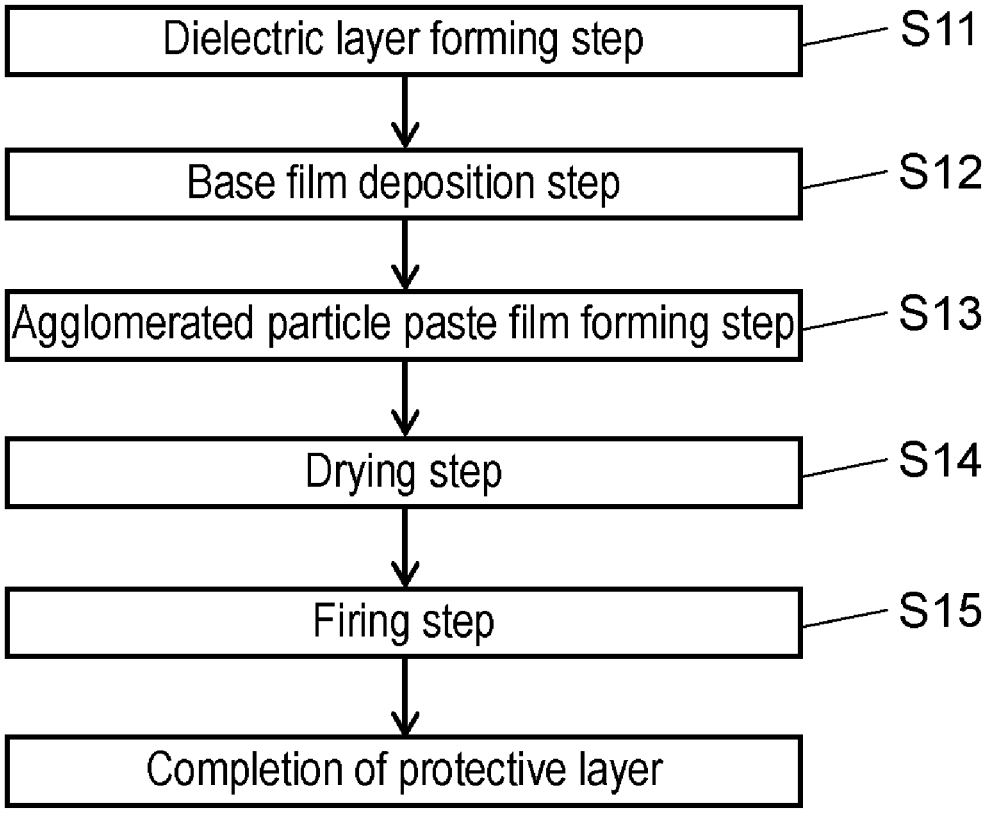
FIG. 14 is a diagram showing steps of forming the protective layer in the manufacturing method of the PDP of the present invention.

FIG. 14 is a diagram showing steps of forming the protective layer in the manufacturing method of the PDP of the present invention. As shown in FIG. 14, dielectric layer forming step S11 of forming dielectric layer 8 having a laminated structure of first dielectric layer 81 and second dielectric layer 82 is performed. Then, in subsequent base film deposition step S12, a base film made of MgO is formed on second dielectric layer 82 of dielectric layer 8 by the vacuum deposition method using a sintered body of MgO containing Al as raw material.

Then, a step of discretely sticking a plurality of agglomerated particles on the un-fired base film that is formed in base film deposition step S12 is performed.

In this step, agglomerated particle paste is firstly prepared by mixing agglomerated particles 92 having a predetermined diameter distribution and a resin component into a solvent, and the agglomerated particle paste is applied to the un-fired base film to form a agglomerated particle paste film by the screen printing method in agglomerated particle paste film forming step S13. As the method of forming the agglomerated particle paste film by applying the agglomerated particle paste to the un-fired base film, not only the screen printing method, but also the spray method, a spin coating method, a die coating method, or a slit coating method can be employed.

After forming the agglomerated particle paste film, drying step S14 of drying the agglomerated particle paste film is performed.

The un-fired base film that is formed in base film deposition step S12 and agglomerated particle paste film that is formed in agglomerated particle paste film forming step S13 and is dried in drying step S14 are simultaneously fired in firing step S15 of heating and firing them at a temperature of hundreds of degrees. Then, by removing the solvent and resin component remaining in the agglomerated particle paste film, protective layer 9 where a plurality of agglomerated particles 92 are stuck on base film 91 can be formed.

This method allows a plurality of agglomerated particles 92 to be stuck on base film 91 so that agglomerated particles 92 are distributed over the whole surface.

In addition to this method, a method of directly spraying the grain group together with gas without using a solvent or a method of spreading it simply using gravity may be employed.

In the above-mentioned description, protective layer 9 is made of MgO, for example. However, the performance required for the base is strictly a high spatter resistance for protecting the dielectric from ion impact, and the electron emission performance is not required to be so high. In the conventional PDP, in order to reconcile the electron emission performance of a certain value or higher with the spatter resistance, a protective layer mainly made of MgO is extremely often formed. Since a structure is employed where the electron emission performance is controlled dominantly by single crystal particles made of metal oxide, however, another material such as $Al_2O_3$ having high impact resistance may by employed.

In the present embodiment, MgO grains are employed as the single crystal particles. However, a similar effect can be produced also when other single crystal particles are employed, for example, also when crystal particles made of metal oxide such as Sr, Ca, Ba, or Al having high electron emission performance similarly to MgO are employed. Therefore, the grain type is not limited to MgO.

When agglomerated particles where a plurality of crystal particles made of metal oxide film are coagulated are stuck and distributed on the whole surface of the base film to form a protective layer so that the base film has two mutually contradictory characteristics, the high electron emission characteristic of the agglomerated particles degrades with time unless impurity gas such as water, hydrocarbon, or organic solvent is sufficiently removed. Therefore, in order to keep the electron emission performance, the impurity gas is required to be sufficiently removed.

The present invention provides a PDP that has an improved electron emission characteristic, has a charge retention characteristic, and can reconcile high image quality with low cost, low voltage, and long lifetime. Therefore, a PDP can be achieved which consumes only low power, and has display performance of high definition and high luminance.

The present invention is useful for achieving a PDP that has display performance of high definition and high luminance, consumes only low power, and has a long lifetime.

REFERENCE MARKS IN THE DRAWINGS

1 PDP
2 front plate
3 front glass substrate
4 scan electrode
4*a*, 5*a* transparent electrode
4*b*, 5*b* metal bus electrode
5 sustain electrode
6 display electrode
7 black stripe (light shielding layer)
8 dielectric layer
9 protective layer
10 rear plate
11 rear glass substrate
12 address electrode
13 base dielectric layer
14 barrier rib
15 phosphor layer
16 discharge space
17 hydrogen storage material
81 first dielectric layer
82 second dielectric layer
91 base film
92 agglomerated particle
92*a* crystal particle

The invention claimed is:

1. A plasma display panel, comprising:

a front plate having a dielectric layer and a protective layer formed on the dielectric layer, the dielectric layer covering a display electrode formed on a substrate; and a rear plate facing the front plate so as to form a discharge space, and having an address electrode in a direction crossing the display electrode, a barrier rib for partitioning the discharge space, and a phosphor layer, wherein the protective layer is produced by forming a ground film on the dielectric layer and sticking a plurality of agglomerated particles to the ground film, each agglomerated particle being agglomerated by a plurality of crystal particles made of metal oxide, wherein each of the plurality of agglomerated particles is discretely disposed on the ground film, and wherein a hydrogen storage material is disposed in the discharge space between the front plate and rear plate.

2. The plasma display panel of claim 1, wherein an average grain diameter of the agglomerated particle is between 0.9 and 2 μm, inclusive.

3. The plasma display panel of claim 1, wherein the ground film is made of MgO.

4. The plasma display panel of claim 1, wherein the hydrogen storage material is disposed on the phosphor layer or in the phosphor layer.

5. The plasma display panel of claim 1, wherein the hydrogen storage material is disposed on the barrier rib or in the barrier rib.

6. The plasma display panel of claim 1, wherein the hydrogen storage material is disposed on the protective layer.

* * * * *

UNITED STATES PATENT AND TRADEMARK OFFICE

CERTIFICATE OF CORRECTION

PATENT NO. : 8,154,204 B2
APPLICATION NO. : 12/596787
DATED : April 10, 2012
INVENTOR(S) : Kaname Mizokami et al.

It is certified that error appears in the above-identified patent and that said Letters Patent is hereby corrected as shown below:

ON THE TITLE PAGE AND IN THE SPECIFICATION:
In Item (54) and in column 1, line 1, "PLASMA DISPLAY DEVICE" should read --PLASMA DISPLAY PANEL--.

Signed and Sealed this
Twenty-fifth Day of September, 2012

David J. Kappos

David J. Kappos
*Director of the United States Patent and Trademark Office*